US009035113B2

(12) United States Patent
Lopez et al.

(10) Patent No.: US 9,035,113 B2
(45) Date of Patent: May 19, 2015

(54) HIGH ENERGY DISTILLATE FUEL COMPOSITION AND METHOD OF MAKING THE SAME

(75) Inventors: Jaime Lopez, Benicia, CA (US); Janine Lichtenberger, Richmond, CA (US); William J. Cannella, Orinda, CA (US); Curtis L. Munson, Oakland, CA (US)

(73) Assignee: Cherron U.S.A. Inc., San Ramon, CA (US)

( * ) Notice: Subject to any disclaimer, the term of this patent is extended or adjusted under 35 U.S.C. 154(b) by 0 days.

(21) Appl. No.: 12/582,809

(22) Filed: Oct. 21, 2009

(65) Prior Publication Data

US 2010/0270205 A1 Oct. 28, 2010

Related U.S. Application Data

(60) Provisional application No. 61/107,627, filed on Oct. 22, 2008.

(51) Int. Cl.

| | |
|---|---|
| ***C10L 1/04*** | (2006.01) |
| ***C10G 65/12*** | (2006.01) |
| ***C10G 45/44*** | (2006.01) |
| ***C10G 47/00*** | (2006.01) |

(52) U.S. Cl.

CPC ..... *C10G 65/12* (2013.01); *C10G 45/44* (2013.01); *C10G 47/00* (2013.01); *C10G 2300/1048* (2013.01); *C10G 2400/08* (2013.01); *C10L 1/04* (2013.01); *C10G 2300/30* (2013.01)

(58) Field of Classification Search

CPC ..... C10L 1/04; C10L 1/608; C10L 2200/043; C10L 2270/04; C10G 2300/1051; C10G 2300/1096; C10G 2400/08

USPC ..... 44/300; 208/15; 585/14, 20, 21

See application file for complete search history.

(56) References Cited

U.S. PATENT DOCUMENTS

| | | | | | |
|---|---|---|---|---|---|
| 2,964,393 | A | | 12/1960 | McLaughlin et al. | |
| 3,012,961 | A | | 12/1961 | Weisz | |
| 3,130,007 | A | | 4/1964 | Breck | |
| 3,222,274 | A | | 12/1965 | Carl | |
| 3,367,860 | A | | 2/1968 | Barries et al. | |
| 3,536,605 | A | | 10/1970 | Kittrell | |
| 3,620,961 | A | * | 11/1971 | Ireland et al. | 208/79 |
| 3,808,326 | A | | 4/1974 | McDaniel et al. | |
| 3,835,027 | A | | 9/1974 | Ward | |
| 4,162,961 | A | | 7/1979 | Marmo | |
| 4,619,759 | A | | 10/1986 | Myers et al. | |
| 4,645,585 | A | * | 2/1987 | White | 208/58 |
| 4,764,266 | A | | 8/1988 | Chen et al. | |
| 4,875,992 | A | * | 10/1989 | Hamner | 208/89 |
| 4,968,402 | A | | 11/1990 | Kirker et al. | |
| 5,189,232 | A | | 2/1993 | Shabtai et al. | |
| 5,219,814 | A | | 6/1993 | Kirker et al. | |
| 5,520,799 | A | | 5/1996 | Brown et al. | |
| 5,868,921 | A | | 2/1999 | Barre et al. | |
| 5,954,941 | A | * | 9/1999 | Mercier et al. | 208/15 |

(Continued)

*Primary Examiner* — Ellen McAvoy

(74) *Attorney, Agent, or Firm* — Josetta I. Jones; M. Carmen & Associates

(57) ABSTRACT

The disclosure describes a high energy density jet fuel composition, having a smoke point about 18 mm as determined by ASTM D1322 and a thermal stability of no more than 25 mm Hg as determined by ASTM D 3241, and a method for making a jet fuel composition, wherein the net heat of combustion is determined by the aromatics content, cycloparaffins content, and normal plus or iso paraffins content in the jet fuel composition.

6 Claims, 2 Drawing Sheets

(56) References Cited

U.S. PATENT DOCUMENTS

| | | | | |
|---|---|---|---|---|
| 6,444,865 | B1 | 9/2002 | Barre et al. | |
| 6,821,412 | B1 | 11/2004 | Fujukawa et al. | |
| 7,005,057 | B1 | 2/2006 | Kalnes | |
| 7,320,748 | B2 * | 1/2008 | Hemighaus et al. | 208/14 |
| 7,374,657 | B2 * | 5/2008 | Miller et al. | 208/14 |
| 2005/0027148 | A1 | 2/2005 | Connor | |
| 2006/0138022 | A1 | 6/2006 | Miller et al. | |
| 2006/0138024 | A1 | 6/2006 | Miller et al. | |
| 2007/0187291 | A1 * | 8/2007 | Miller et al. | 208/15 |
| 2007/0187292 | A1 | 8/2007 | Miller et al. | |
| 2008/0249341 | A1 | 10/2008 | Tsao et al. | |
| 2009/0000185 | A1 * | 1/2009 | Aulich et al. | 44/308 |
| 2009/0100746 | A1 * | 4/2009 | Lopez et al. | 44/300 |
| 2009/0159489 | A1 * | 6/2009 | Lopez et al. | 208/15 |
| 2009/0314683 | A1 * | 12/2009 | Matsushita | 208/111.3 |
| 2010/0025298 | A1 * | 2/2010 | Hommeltoft et al. | 208/135 |
| 2011/0005190 | A1 * | 1/2011 | Bauldreay et al. | 60/39.461 |
| 2012/0211399 | A1 * | 8/2012 | Cannella et al. | 208/15 |

* cited by examiner

Novel Single Stage Process with High Activity Base Metal Catalysts

HIGH ENERGY DISTILLATE FUEL COMPOSITION AND METHOD OF MAKING THE SAME

FIELD OF THE INVENTION

The present invention relates to a high energy distillate fuel composition and method of making the fuel composition.

BACKGROUND OF THE INVENTION

Heavy hydrocarbon streams, such as FCC Light Cycle Oil ("LCO"), Medium Cycle Oil ("MCO"), and Heavy Cycle Oil ("HCO"), have a relatively low value. Typically, such hydrocarbon streams are upgraded through hydroconversion.

Hydrotreating catalysts are well known in the art. Conventional hydrotreating catalysts comprise at least one Group VIII metal component and/or at least one Group VIB metal component supported on a refractory oxide support. The Group VIII metal component may either be based on a non-noble metal, such as nickel (Ni) and/or cobalt (Co), or may be based on a noble metal, such as platinum (Pt) and/or palladium (Pd). Group VIB metal components include those based on molybdenum (Mo) and tungsten (W). The most commonly applied refractory oxide support materials are inorganic oxides such as silica, alumina and silica-alumina and aluminosilicates, such as modified zeolite Y. Examples of conventional hydrotreating catalyst are NiMo/alumina, CoMo/alumina, NiW/silica-alumina, Pt/silica-alumina, PtPd/silica-alumina, Pt/modified zeolite Y and PtPd/modified zeolite Y.

Hydrotreating catalysts are normally used in processes wherein a hydrocarbon oil feed is contacted with hydrogen to reduce its content of aromatic compounds, sulfur compounds, and/or nitrogen compounds. Typically, hydrotreating processes wherein reduction of the aromatics content is the main purpose are referred to as hydrogenation processes, while processes predominantly focusing on reducing sulfur and/or nitrogen content are referred to as hydrodesulfurization and hydrodenitrogenation, respectively.

The present invention is directed to a jet fuel composition derived from method of hydrotreating gas oil feedstocks with a catalyst in the presence of hydrogen and in a single stage reactor.

DESCRIPTION OF THE RELATED ART

Marmo, U.S. Pat. No. 4,162,961 discloses a cycle oil that is hydrogenated under conditions such that the product of the hydrogenation process can be fractionated.

Myers et al., U.S. Pat. No. 4,619,759 discloses the catalytic hydrotreatment of a mixture comprising a resid and a light cycle oil that is carried out in a multiple catalyst bed in which the portion of the catalyst bed with which the feedstock is first contacted contains a catalyst which comprises alumina, cobalt, and molybdenum and the second portion of the catalyst bed through which the feedstock is passed after passing through the first portion contains a catalyst comprising alumina to which molybdenum and nickel have been added.

Kirker et al., U.S. Pat. No. 5,219,814 discloses a moderate pressure hydrocracking process in which highly aromatic, substantially dealkylated feedstock is processed to high octane gasoline and low sulfur distillate by hydrocracking over a catalyst, preferably comprising ultrastable Y and Group VIII metal and a Group VI metal, in which the amount of the Group VIII metal content is incorporated at specified proportion into the framework aluminum content of the ultrastable Y component.

Kalnes, U.S. Pat. No. 7,005,057 discloses a catalytic hydrocracking process for the production of ultra low sulfur diesel wherein a hydrocarbonaceous feedstock is hydrocracked at elevated temperature and pressure to obtain conversion to diesel boiling range hydrocarbons.

Barre et al., U.S. Pat. No. 6,444,865 discloses a catalyst, which comprises from 0.1 to 15 wt % of noble metal selected from one or more of platinum, palladium, and iridium, from 2 to 40 wt % of manganese and/or rhenium supported on an acidic carrier, used in a precess wherein a hydrocarbon feedstock comprising aromatic compounds is contacted with the catalyst at elevated temperature in the presence hydrogen.

Bane et al., U.S. Pat. No. 5,868,921 discloses a hydrocarbon distillate fraction that is hydrotreated in a single stage by passing the distillate fraction downwardly over a stacked bed of two hydrotreating catalysts.

Fujukawa et al., U.S. Pat. No. 6,821,412 discloses a catalyst for hydrotreatment of gas oil containing defined amounts of platinum, palladium and in support of an inorganic oxide containing a crystalline alumina having a crystallite diameter of 20 to 40 Å. Also disclosed id a method for hydrotreating gas oil containing an aromatic compound in the presence of the above catalyst at defined conditions.

Kirker et al., U.S. Pat. No. 4,968,402 discloses a one stage process for producing high octane gasoline from a highly aromatic hydrocarbon feedstock.

Brown et al., U.S. Pat. No. 5,520,799 discloses a process for upgrading distillate feeds. Hydroprocessing catalyst is placed in a reaction zone, which is usually a fixed bed reactor under reactive conditions and low aromatic diesel and jet fuel are produced.

Connor, U.S. Published Patent Application No. 2005/0027148.

Barnes, U.S. Pat. No. 3,367,860.

Hamner, U.S. Pat. No. 4,875,992.

Tsao et al., U.S. Published Patent Application No. 2008/0249341.

Carl, U.S. Pat. No. 3,222,274.

McLaughlin et al., U.S. Pat. No. 2,964,393.

Shabtai et al., U.S. Pat. No. 5,189,232.

SUMMARY OF THE INVENTION

In one embodiment, the present invention is directed to a jet fuel composition, comprising:

(a) an aromatics content of less than 22 vol %;
(b) a cycloparaffins content of at least 72 vol. %;
(c) a normal plus iso paraffin content of less than 28 vol. %;
(d) a net heat of combustion of at least 128,000 Btu/gal;
(e) a smoke point above 19 mm by ASTM D 1322; and
(f) a JFTOT thermal stability characterized by a filter pressure drop of no more than 25 mm Hg, a breakpoint temperature above 290 degrees C., and an overall tube deposit rating less than 3 by ASTM D 3241.

In one embodiment, the present invention is directed to a jet fuel composition, comprising:

(a) an aromatics content of between 10 and 20 vol %;
(b) a cycloparaffins content of from about 80 and about 90 vol. %;
(c) a normal plus iso paraffin content of less than 10 vol. %;
(d) a net heat of combustion of at least 128,000 Btu/gal;
(e) a smoke point above 19 mm by ASTM D 1322; and
(f) a JFTOT thermal stability characterized by a filter pressure drop of no more than 25 mm Hg, a breakpoint temperature above 290 degrees C., and an overall tube deposit rating less than 3 by ASTM D 3241.

In one embodiment, the present invention is directed to a process for making jet fuel, comprising:

(a) hydroprocessing a feed comprising at least 50 vol % of an FCC cycle oil to produce a high density jet fuel having
  (i) an aromatics content of less than 22 vol %;
  (ii) a cycloparaffins content of at least 72 vol. %;
  (iii) a normal plus iso paraffin content of less than 28 vol. %;
  (iv) a net heat of combustion of at least 128,000 Btu/gal;
  (v) a smoke point above 19 mm by ASTM D 1322; and
  (vi) a JFTOT thermal stability characterized by a filter pressure drop of no more than 25 mm Hg, a break-point temperature above 290 degrees C., and an overall tube deposit rating less than 3 by ASTM D 3241.

In one embodiment the present invention is directed to a process for making jet fuel, comprising:

(a) hydroprocessing a feed comprising at least 50 vol % aromatics to produce a high density jet fuel having
  (i) an aromatics content of less than 22 vol %;
  (ii) a cycloparaffins content of at least 72 vol. %;
  (iii) a normal plus iso paraffin content of less than 28 vol. %;
  (iv) a net heat of combustion of at least 129,000 Btu/gal;
  (v) a smoke point above 19 mm by ASTM D 1322; and
  (vi) a JFTOT thermal stability characterized by a filter pressure drop of no more than 25 mm Hg, a break-point temperature above 290 degrees C., and an overall tube deposit rating less than 3 by ASTM D 3241.

In one embodiment, the present invention is directed to a method of increasing energy density of a jet fuel composition comprising (a) mixing a jet fuel composition having an energy density of no more than 127,000 Btu/gal with
(b) a jet fuel composition having the following characteristics:
  (i) an aromatics content of less than 22 vol %;
  (ii) a cycloparaffins content of at least 72 vol. %;
  (iii) a normal plus iso paraffin content of less than 28 vol. %;
  (iv) a net heat of combustion of at least 129,000 Btu/gal;
  (v) a smoke point above 19 mm by ASTM D 1322; and
  (vi) a JFTOT thermal stability characterized by a filter pressure drop of no more than 25 mm Hg, a break-point temperature above 290 degrees C., and an overall tube deposit rating less than 3 by ASTM D 3241.

In one embodiment, the present invention is directed to a jet fuel blendstock comprising (a) a jet fuel composition having an energy density of no more than 127,000 Btu/gal; and
(b) a jet fuel composition having the following characteristics:
  (i) an aromatics content of less than 22 vol %;
  (ii) a cycloparaffins content of at least 72 vol. %;
  (iii) a normal plus iso paraffin content of less than 28 vol. %;
  (iv) a net heat of combustion of at least 129,000 Btu/gal;
  (v) a smoke point above 19 mm by ASTM D 1322; and
  (vi) a JFTOT thermal stability characterized by a filter pressure drop of no more than 25 mm Hg, a break-point temperature above 290 degrees C., and an overall tube deposit rating less than 3 by ASTM D 3241.

DETAILED DESCRIPTION OF THE INVENTION

While the invention is susceptible to various modifications and alternative forms, specific embodiments thereof are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DEFINITIONS

FCC—refers to fluid catalytic crack-er, -ing, or -ed.
HDT—refers to "hydrotreater."
HDC—refers to "hydrocracker."
MUH2—refers to "makeup hydrogen."

Hydrogenation/hydrocracking catalyst may also be referred to as "hydrogenation catalyst" or "hydrocracking catalyst."

The terms "feed", "feedstock" or "feedstream" may be used interchangeably.

JFTOT—refers to Jet Fuel Thermal Oxidation Tester.

A. Overview

Figure 1:
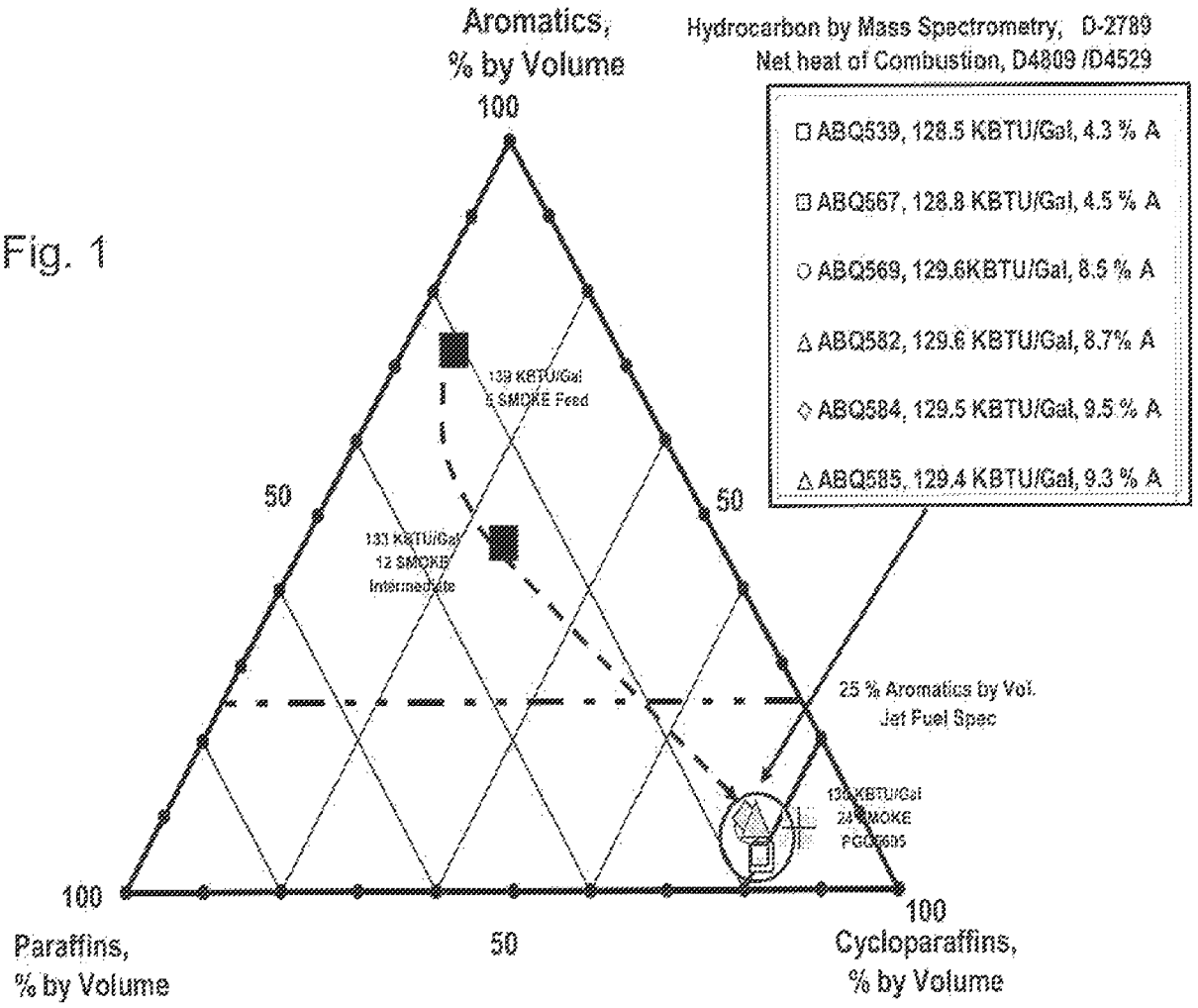
FIG. 1. discloses a ternary diagram plotting aromatic content (vol. %), cycloparaffin content (vol. %), and paraffin (normal and iso) content (vol. %) in a jet fuel composition. The region of the ternary diagram corresponding to the jet fuel composition of the invention is denoted in gray.

Jet fuel compositions having an aromatics content, cycloparaffins content, and normal paraffins content consistent with the current invention are shown in the shaded region in FIG. 1.

Figure 2:
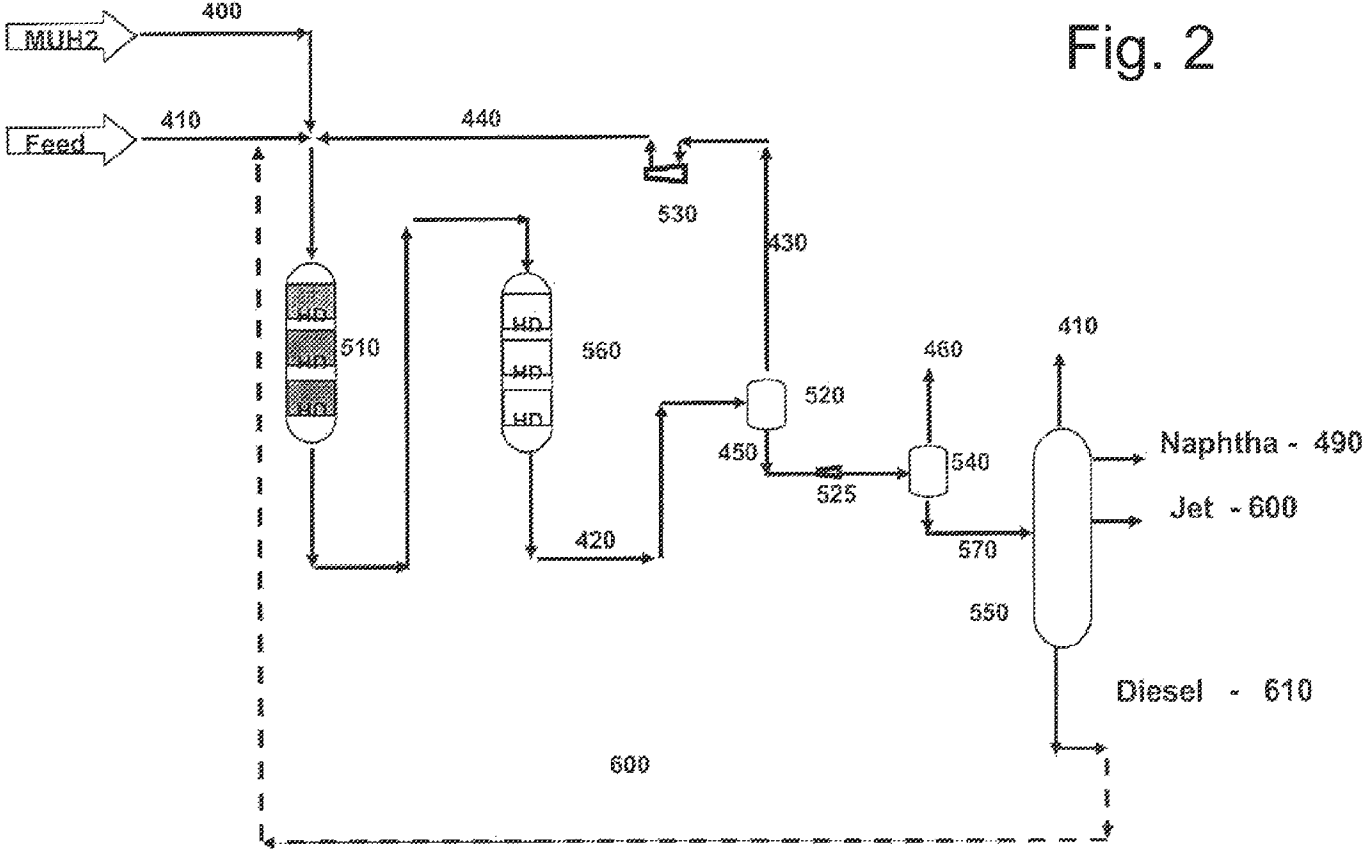
FIG. 2 discloses a single-stage process for producing high energy density naphtha, jet and diesel.

A method of processing a jet fuel composition is described in FIG. 2. In the embodiment shown in FIG. 2, hydrocarbon gas oil 410 is fed to a hydrotreater reactor 510 for sulfur/nitrogen removal and then directly to a hydrogenation/hydrocracking reactor 560. The hydrogenated/hydrocracked product 420 is fed to the high pressure separator 520 where the reactor effluent is separated into a gas 430 and liquid stream 450. The product gas 430 is recompressed by the recycle gas compressor 530 to yield stream 440 which is then recycled into the reactor inlet where it is combined with the makeup hydrogen 400 and hydrocarbon gas oil feed 410. The liquid stream 450 is depressured at the liquid level control valve 525 and the product is separated into a gas stream 460 and into a liquid stream 570 in the low pressure separator 540.

The product stream 470 is fed to a distillation system 550 where the product 470 is separated to yield a gas stream 410, a naphtha product 490, and a high volumetric energy jet fuel 600 and diesel 610. Optionally, a portion of the diesel stream 600 can be recycled to the second stage reactor 460 to balance the jet/diesel product slate.

B. Feed

Hydrocarbon gas oil may be upgraded to jet or diesel. The hydrocarbon gas oil feedstock is selected from FCC effluent, including an FCC light cycle oil, fractions of jet fuels, a coker product, coal liquefied oil, the product oil from the heavy oil thermal cracking process, the product oil from heavy oil hydrocracking, straight run cut from a crude unit, and mixtures thereof, and having a major portion of the feedstock having a boiling range of from about 250° F. to about 800° F., and preferably from about 350° F. to about 600° F. The term "major portion" as used in this specification and the appended claims, shall mean at least 50 wt. %.

Typically, the feedstock is highly aromatic and has up to about 80 wt % aromatics, up to 3 wt % sulfur and up to 1 wt % nitrogen. Preferably, the feedstock has an aromatic carbon content of at least 40 wt % aromatics. Typically, the cetane number is about 25 units.

C. Catalysts

The catalyst system employed in the present invention comprises at least two catalyst layers consisting of a hydrotreating catalyst and a hydrogenation/hydrocracking catalyst. Optionally, the catalyst system may also comprise at least one layer of a demetallization catalyst and at least one layer of a second hydrotreating catalyst. The hydrotreating catalysts contains a hydrogenation component such as a metal from Group VIB and a metal from Group VIII, their oxides, their sulfide, and mixtures thereof and may contain an acidic component such as fluorine, small amounts of crystalline zeolite or amorphous silica alumina.

The hydrocracking catalysts contains a hydrogenation component such as a metal from Group VIB and a metal from Group VIII, their oxides, their sulfide, and mixtures thereof and contains an acidic component such as a crystalline zeolite or amorphous silica alumina.

One of the zeolites which is considered to be a good starting material for the manufacture of hydrocracking catalysts is the well-known synthetic zeolite Y as described in U.S. Pat. No. 3,130,007 issued Apr. 21, 1964. A number of modifications to this material have been reported one of which is ultrastable Y zeolite as described in U.S. Pat. No. 3,536,605 issued Oct. 27, 1970. To further enhance the utility of synthetic Y zeolite additional components can be added. For example, U.S. Pat. No. 3,835,027 issued on Sep. 10, 1974 to Ward et al. describes a hydrocracking catalysts containing at least one amorphous refractory oxide, a crystalline zeolitic aluminosilicate and a hydrogenation component selected from the Group VI and Group VIII metals and their sulfides and their oxides.

A hydrocracking catalyst which is a comulled zeolitic catalyst comprising about 17 weight percent alumina binder, about 12 weight percent molybdenum, about 4 weight percent nickel, about 30 weight percent Y-zeolite, and about 30 weight percent amorphous silica/alumina. This hydrocracking catalyst is generally described in U.S. patent application Ser. No. 870,011, filed by M. M. Habib et al. on Apr. 15, 1992 and now abandoned, the full disclosure of which is hereby incorporated by reference. This more general hydrocracking catalyst comprises a Y zeolite having a unit cell size greater than about 24.55 Angstroms and a crystal size less than about 2.8 microns together with an amorphous cracking component, a binder, and at least one hydrogenation component selected from the group consisting of a Group VI metal and/or Group VIII metal and mixtures thereof.

In preparing a Y zeolite for use in accordance with the invention herein, the process as disclosed in U.S. Pat. No. 3,808,326 should be followed to produce a Y zeolite having a crystal size less than about 2.8 microns.

More specifically, the hydrocracking catalyst suitably comprises from about 30%-90% by weight of Y zeolite and amorphous cracking component, and from about 70%-10% by weight of binder. Preferably, the catalyst comprises rather high amounts of Y zeolite and amorphous cracking component, that is, from about 60%-90% by weight of Y zeolite and amorphous cracking component, and from about 40%-10% by weight of binder, and being particularly preferred from about 80%-85% by weight of Y zeolite and amorphous cracking component, and from about 20%-15% by weight of binder. Preference is given to the use of silica-alumina as the amorphous cracking component.

The amount of Y zeolite in the catalyst ranges from about 5-70% by weight of the combined amount of zeolite and cracking component. Preferably, the amount of Y zeolite in the catalyst compositions ranges from about 10%-60% by weight of the combined amount of zeolite and cracking component, and most preferably the amount of Y zeolite in the catalyst compositions ranges from about 15-40% by weight of the combined amount of zeolite and cracking component.

Depending on the desired unit cell size, the SiO.sub.2/Al.sub.2 O.sub.3 molar ratio of the Y zeolite may have to be adjusted. There are many techniques described in the art which can be applied to adjust the unit cell size accordingly. It has been found that Y zeolites having a SiO.sub.2/Al.sub.2 O.sub.3 molar ratio of from about 3 to about 30 can be suitably applied as the zeolite component of the catalyst compositions according to the present invention. Preference is given to Y zeolites having a molar SiO.sub.2/Al.sub.2 O.sub.3 ratio from about 4 to about 12, and most preferably having a molar SiO.sub.2/Al.sub.2 O.sub.3 ratio from about 5 to about 8.

The amount of cracking component such as silica-alumina in the hydrocracking catalyst ranges from about 10%-50% by weight, preferably from about 25%-35% by weight. The amount of silica in the silica-alumina ranges from about 10%-70% by weight. Preferably, the amount of silica in the silica-alumina ranges from about 20%-60% by weight, and most preferably the amount of silica in the silica-alumina ranges from about 25%-50% by weight. Also, so-called X-ray amorphous zeolites (i.e., zeolites having crystallite sizes too small to be detected by standard X-ray techniques) can be suitably applied as cracking components according to the process embodiment of the present invention. The catalyst may also contain fluorine at a level of from about 0.0 wt % to about 2.0 wt %.

The binder(s) present in the hydrocracking catalyst suitably comprise inorganic oxides. Both amorphous and crystalline binders can be applied. Examples of suitable binders comprise silica, alumina, clays and zirconia. Preference is given to the use of alumina as binder.

The amount(s) of hydrogenation component(s) in the catalyst suitably range from about 0.5% to about 30% by weight of Group VIII metal component(s) and from about 0.5% to about 30% by weight of Group VI metal component(s), calculated as metal(s) per 100 parts by weight of total catalyst. The hydrogenation components in the catalyst may be in the oxidic and/or the sulphidic form. If a combination of at least a Group VI and a Group VIII metal component is present as (mixed) oxides, it will be subjected to a sulphiding treatment prior to proper use in hydrocracking.

Suitably, the catalyst comprises one or more components of nickel and/or cobalt and one or more components of molybdenum and/or tungsten or one or more components of platinum and/or palladium.

The hydrotreating catalyst comprises from about 2%-20% by weight of nickel and from about 5%-20% by weight molybdenum. Preferably the catalyst comprises 3%-10% nickel and from about 5%-20 molybdenum. More preferred, the catalyst comprises from about 5%-10% by weight of nickel and from about 10%-15% by weight molybdenum, calculated as metals per 100 parts by weight of total catalyst. Even more preferred, the catalyst comprises from about 5%-8% nickel and from about 8% to about 15% nickel. The total weight percent of metals employed in the hydrotreating catalyst is at least 15 wt %.

In one embodiment, the ratio of the nickel catalyst to the molybdenum catalyst is no greater than about 1:1.

The active metals in the hydrogenation/hydrocracking catalyst comprise nickel and at least one or more VI B metal. Preferably, the hydrogenation/hydrocracking catalyst comprises nickel and tungsten or nickel and molybdenum. Typically, the active metals in the hydrogenation/hydrocracking catalyst comprise from about 3%-30% by weight of nickel and from about 2%-30% by weight tungsten, calculated as metals per 100 parts by weight of total catalyst. Preferably, the active metals in the hydrogenation/hydrocracking catalyst comprise from about 5%-20% by weight of nickel and from about 5%-20% by weight tungsten. More preferred, the active metals in the hydrogenation/hydrocracking catalyst comprise from about 7%-15% by weight of nickel and from about 8%-15% by weight tungsten. Most preferred, the active metals in the hydrogenation/hydrocracking catalyst comprise from about 9%-15% by weight of nickel and from about 8%-13% by weight tungsten. The total weight percent of the metals is from about 25 wt % to about 40 wt %.

Optionally, the acidity of the hydrogenation/hydrocracking catalyst may be enhanced by adding at least 1 wt % fluoride, preferably from about 1-2 wt % fluoride.

In another embodiment, the hydrogenation/hydrocracking catalyst may be replaced by a similarly high activity base metal catalyst where the support is an amorphous alumina or silica or both and where the acidity has been enhanced by a zeolite, such as H—Y in a concentration of from about 0.5 wt % to about 15 wt %.

The effective diameter of the hydrotreating catalyst particles was about 0.1 inch, and the effective diameter of the hydrocracking catalyst particles was also about 0.1 inch. The two catalysts are intermixed in a weight ratio of about 1.5:1 hydrotreating to hydrocracking catalyst.

Optionally, a demetallization catalyst may be employed in the catalyst system. Typically, the demetallization catalyst comprises Group VIB and Group VIII metals on a large pore alumina support. The metals may comprise nickel, molybdenum and the like on a large pore alumina support. Preferably, at least about 2 wt % nickel is employed and at least about 6 wt % molybdenum is employed. The demetallization catalyst may be promoted with at least about 1 wt % phosphorous.

Optionally, a second hydrotreating catalyst may also be employed in the catalyst system. The second hydrotreating catalyst comprises the same hydrotreating catalyst as described herein.

D. Products

It has also been discovered that the net heat of combustion of a jet fuel composition, having a smoke point about 18 mm as determined by ASTM D1322 and a thermal stability of no more than 25 mm Hg as determined by ASTM D 3241, may be determined by interpolating the aromatic content, cycloparaffin content, normal plus iso paraffin content.

As discussed hereinabove, FIG. 1 discloses a ternary diagram plotting aromatic content (vol. %), cycloparaffin content (vol. %), and paraffin (normal and iso) content (vol. %) in a jet fuel composition. All volume percents were determined by ASTM D2789. The region of the ternary diagram corresponding to the jet fuel composition of the invention is denoted in gray.

In one embodiment, a jet fuel composition has an aromatics content of less than 22 vol %; a cycloparaffins content of at least 70 vol %; a normal plus isoparaffin content of less than 30 vol %; a net heat of combustion of at least 128,00 Btu/gal; a smoke point of at least 18 mm as determined by ASTM D1322; and a JFTOT thermal stability characterized by a filter pressure drop of no more than 25 mm Hg, a breakpoint temperature above 290 degrees C., and an overall tube deposit rating less than 3 by ASTM D 3241.

Preferably, the jet fuel composition has an aromatic content of less than 22 vol %; a cycloparaffins content of at least 72 vol %; a normal plus iso paraffin content of less than 28 vol %; a net heat of combustion of at least 129,000 Btu/gal; a smoke point of at least 19 mm as determined by ASTM D 1322; and a JFTOT thermal stability characterized by a filter pressure drop of no more than 25 mm Hg, a breakpoint temperature above 290 degrees C., and an overall tube deposit rating less than 3 by ASTM D 3241.

More preferred, the jet fuel composition has an aromatic content of less than 22 vol %; a cycloparaffins content of at least 72 vol %; a normal plus iso paraffin content of less than 28 vol %; a net heat of combustion of at least 130,000 Btu/gal; a smoke point of at least 19 mm as determined by ASTM D 1322; and a JFTOT thermal stability characterized by a filter pressure drop of no more than 25 mm Hg, a breakpoint temperature above 290 degrees C., and an overall tube deposit rating less than 3 by ASTM D 3241.

Even more preferred, the jet fuel composition has an aromatics content of from about 5 to about 20 vol %; a cycloparaffins content of from about 80 to about 95 vol %; a normal plus iso paraffin content of less than about 5 vol %; a net heat of combustion of at least 128,000 Btu/gal; a smoke point of at least 18 mm as determined by ASTM D1322; and a JFTOT thermal stability characterized by a filter pressure drop of no more than 25 mm Hg, a breakpoint temperature above 290 degrees C., and an overall tube deposit rating less than 3 by ASTM D 3241.

Most preferred, the jet fuel composition has an aromatics content of from about 10 to about 20 vol %; a cycloparaffins content of from about 80 to about 90 vol %; a normal plus iso paraffin content of less than about 10 vol %; a net heat of combustion of at least 129,000 Btu/gal; a smoke point of at least 18 mm as determined by ASTM D1322; and a JFTOT thermal stability characterized by a filter pressure drop of no more than 25 mm Hg, a breakpoint temperature above 290 degrees C., and an overall tube deposit rating less than 3 by ASTM D 3241.

Even most preferred, the jet fuel composition has an aromatics content of from about 10 to about 20 vol %; a cycloparaffins content of from about 80 to about 90 vol %; a normal plus iso paraffin content of less than about 10 vol %; a net heat of combustion of at least 130,000 Btu/gal; a smoke point of at least 18 mm as determined by ASTM D1322; and a JFTOT thermal stability characterized by a filter pressure drop of no more than 25 mm Hg, a breakpoint temperature above 290 degrees C., and an overall tube deposit rating less than 3 by ASTM D 3241.

In one embodiment, the JFTOT thermal stability has a filter pressure drop of no more than 25 mm Hg; a breakpoint temperature above 290 degrees C., preferably greater than 295 degrees C., still more preferably greater than 300 degrees C., and most preferably greater than 310 degrees C.; and an overall tube deposit rating less than 3 by ASTM D 3241.

The jet fuel composition described above may be prepared by the process employed in the present invention, which upgrades heavy hydrocarbon feedstreams to either jet and/or diesel products. The products of the present process may include jet or diesel fuels or both having a high volumetric energy density.

In one embodiment, the jet fuel composition of the present invention may be mixed with other jet fuel compositions that do not have a high volumetric energy density, thereby producing a jet fuel blendstock. Preferably, the jet fuel blendstock comprises (a) a jet fuel composition having an energy density of no more than 127,000 Btu/gal; and (b) a jet fuel composition having the following characteristics: (i) an aromatics content of less than 22 vol %; (ii) a cycloparaffins content of at least 72 vol. %; (iii) a normal plus iso paraffin content of less than 28 vol. %; (iv) a net heat of combustion of at least 129,000 Btu/gal; (v) a smoke point above 19 mm by ASTM D 1322; and (vi) a JFTOT thermal stability characterized by a filter pressure drop of no more than 25 mm Hg, a breakpoint temperature above 290 degrees C., and an overall tube deposit rating less than 3 by ASTM D 3241.

Typically, the jet fuel composition prepared by the process employed in the present invention has aromatic saturation (i.e., low aromatic content) greater than or equal to 70 wt %. The product also has an energy density that is greater than 120,000 Btu/gal, preferably greater than 125,000 Btu/gal. The jet fuel product has a smoke point of greater than 20 mm. The jet fuel product also has a freeze point of less than −40 degrees C. Preferably, the freeze point is less than −50 degrees C. The diesel product has a cetane index of at least 40.

In one embodiment, the product jet fuel compositions are prepared by hydroprocessing a feedstream comprising at least 50 vol % of an FCC cycle oil to produce a high density energy jet fuel having an aromatics content of less than 22 vol %; a cycloparaffins content of at least 70 vol %; a normal plus isoparaffin content of less than 30 vol %; a net heat of combustion of at least 128,00 Btu/gal; a smoke point of at least 18 mm as determined by ASTM D1322; and a thermal stability of no more than 25 mm Hg as determined by ASTM D3241.

Preferably, the product jet fuel compositions are prepared by hydroprocessing a feedstream comprising at least 50 vol % of an FCC cycle oil to produce a high density energy jet fuel having an aromatics content of from about 5 to about 20 vol %; a cycloparaffins content of from about 80 to about 95 vol %; a normal plus iso paraffin content of less than about 5 vol %; a net heat of combustion of at least 128,000 Btu/gal; a smoke point of at least 18 mm as determined by ASTM D1322; and a thermal stability of no more than 25 mm Hg as determined by ASTM D 3241.

In one embodiment of the present invention, the aviation turbine fuel composition has a particularly high thermal oxidation stability. The high thermal oxidation stability of the fuel of the present invention is a very desirable feature in jet turbine fuel and provides an additional margin of safety characterized by minimal deposit formation at operational conditions. The thermal oxidation stability is measured by the JFTOT procedure (ASTM D 3241).

In one embodiment a method of increasing energy density of a jet fuel composition comprises (a) mixing a jet fuel composition having an energy density of no more than 127,000 Btu/gal with (b) a jet fuel composition having the following characteristics: an aromatics content of less than 22 vol %; a cycloparaffins content of at least 72 vol. %; a normal plus iso paraffin content of less than 28 vol. %; a net heat of combustion of at least 129,000 Btu/gal; a smoke point above 19 mm by ASTM D 1322; and a JFTOT thermal stability characterized by a filter pressure drop of no more than 25 mm Hg, a breakpoint temperature above 290 degrees C., and an overall tube deposit rating less than 3 by ASTM D 3241.

E. Process Conditions

One embodiment of the present invention is a method of making a high energy distillate fuel, preferably having a boiling range in the jet and/or diesel boiling ranges. This method comprises contacting the heavy, highly aromatic hydrocarbonaceous feed, as described herein, with a catalyst system which consists of a hydrotreating catalyst and a hydrocracking catalyst. The reaction system operates as a single stage reaction process under essentially the same pressure and recycle gas flowrate. The reaction system has two sections: a hydrotreating section and a hydrocracking section, which are located in series. There is a pressure differential between the hydrotreating section and the hydrocracking section caused by pressure drop due to flow through the catalyst. The pressure differential is no more than about 200 psi. More preferred the pressure differential is no more than 100 psi. Most preferred the pressure differential is no more than 50 psi.

Representative feedstocks include highly aromatic refinery streams such as fluid catalytic cracking cycle oils, thermally cracked distillates, and straight run distillates, which come from the crude unit. These feedstocks generally have a boiling-range above about 200.degree. F. and generally have a boiling range between 350.degree. F. and about 750.degree. F.

The hydrocarbonaceous feedstock is contacted with hydrogen in the presence of the catalyst system under upgrading conditions which generally include a temperature in the range of from about 550° F. to about 775° F., preferably from about 650° F. to about 750° F., and most preferred from about 700° F. to about 725° F.; a pressure of from about 750 pounds per square inch absolute (psia) to about 3,500 psia, preferably from about 1,000 psia to about 2,500 psia, and most preferred from about 1250 psia to about 2000 psia; and a liquid hourly space velocity (LHSV) of from about 0.2 to about 5.0, preferably from about 0.5 to about 2.0, and most preferred from about 0.8 to about 1.5; and an oil to gas ratio of from about 1,000 standard cubic feet per barrel (scf/bbl) to about 15,000 scf/bbl, preferably from about 4,000 scf/bbl to about 12,000 scf/bbl, and most preferred from about 6,000 scf/bbl to about 10,000 scf/bbl.

F. Process Equipment

The catalyst system of the present invention can be used in a variety of configurations. In the present invention, however, the catalyst is used in a single stage reaction system. Preferably, a reaction system contains a hydrotreater and a hydrocracker reactor operating in the same recycle gas loop and at essentially the same pressure. For example, the highly aromatic feed is introduced to the high pressure reaction system, which contains the hydrotreating and hydrocracking catalysts. The feed is combined with recycled hydrogen and introduced to the reaction system which comprises a first section containing a hydrotreating catalyst and a second section containing a hydrocracking catalyst. The first section comprises at least one reaction bed containing a hydrotreating catalyst. The second section comprises at least one reaction bed containing a hydrocracking catalyst. Both sections are operating at the same pressure. Under reaction conditions, the highly aromatic feed is saturated to extremely high levels therein producing a highly saturated product. The effluent from the reaction system is a highly saturated product having a boiling range in the jet and diesel ranges. After the reaction has taken place, the reaction product is fed to a separation unit (i.e., distillation column and the like) in order to separate the high energy density jet, the high energy density diesel, naptha and other products. Un-reacted product may be recycled to the reaction system for further processing to maximize jet or diesel production.

Other embodiments will be obvious to those skilled in the art.

The following examples are presented to illustrate specific embodiments of this invention and are not to be construed in any way as limiting the scope of the invention.

EXAMPLES

Example A

Feedstream Description

| | Feed | | |
|---|---|---|---|
| | A. 50/50 LCO/MCO | B. LCO | C. MCO |
| API | 14.7 | 20.8 | 8.0 |
| Specific Gravity | 0.9658 | 0.9271 | 1.0122 |
| Nitrogen, ppm | 473 | 98 | 848 |
| Sulfur, wt. % | 0.33 | 0.12 | 0.51 |
| Hydrogen, wt. % | 9.1 | 9.6 | 8.6 |
| Carbon, wt. % | 90.5 | 90.3 | 90.8 |
| Aromatic Carbon by NDM, % | 73 | 69 | 77 |
| Distillation, D2887 | | | |
| IBP | 291 | 281 | 356 |
| 10% | 436 | 407 | 483 |
| 30% | 462 | 452 | 534 |
| 50% | 500 | 459 | 577 |
| 70% | 560 | 488 | 626 |
| 90% | 656 | 514 | 658 |
| EP | 807 | 572 | 859 |
| Characterization Factor, Kw | 10.21 | 10.49 | 10.0 |

Example 1

A blend of light and medium cycle oil (i.e., Feed A. from Example A), having a boiling range of about 300 degrees F. to 775 degrees F. and an aromatic carbon content of 73% as measured by nDM method, was fed to a single stage reactor, which comprised a catalyst system, having a liquid hourly space velocity (LHSV) of 1.0 l/Hr. A catalyst system was employed to produce the product. This catalyst system comprised layers of a demetallization catalyst, a hydrotreating catalyst and a hydrogenation/hydrocracking catalyst. The demetallization catalyst comprised Group VI and Group VIII metals, specifically 2 wt % nickel and 6 wt % molybdenum, on a large pore support. The catalyst was promoted with phosphorus. The hydrotreating catalyst consisted of a Group VI and Group VIII metals catalysts, which was promoted with phosphorus, on a large surface area alumina, non-acidic support. The total metals were 20 wt %. The hydrogenation/hydrocracking catalyst is a high activity base metal catalyst consisting of 20 wt % nickel/20 wt % tungsten over a large area amorphous silica alumina, where the acidity was enhanced by adding 2 wt % fluoride as hydrofluoric acid. The temperature of the reactor was 650° F. Hydrogen, having a pressure of 2130 p.s.i.g, was fed to the reactor at a rate of 8000 scf/bbl. The pressure differential is 0 psi. The reaction product yields are set forth in Table 1A & 1B.

TABLE 1A

| Product | Yield |
|---|---|
| Hydrogen Consumption | 2290 scf/bbl |
| Hydrogen Sulfide (wt %) | 0.36 |
| Ammonia (wt %) | 0.06 |
| C1/C2 Lt. Gas Make (wt %) | 0.4 |
| C3/C4 LPG (vol %) | 0.4 |
| Naphtha (vol %) | 9.4 |
| Jet Fuel (vol %) | 87.3 |
| Diesel (vol %) | 22.7 |
| Total (vol %) | 119.8 |
| Jet Plus Diesel (vol %) | 110.0 |

TABLE 1B

Jet and Diesel Product Qualities

| | Jet | Diesel |
|---|---|---|
| API Gravity | 33.0 | 26.2 |
| Specific Gravity, G/cc | 0.858 | 0.895 |
| Sulfur (wt %) | 0.06 | 0.06 |
| D1319 Aromatics (vol %) | 7 | <5 |
| Smoke Point, mm: CRTC | 20 | — |
| Cetane Index | — | 40 |
| Freeze Point (° C.) | −58 | −8 |
| D-86 Boiling Range (F.) | — | — |
| D2887 5%/95% F. | 323/559 | 509/732 |
| Flash Point (F.) | 123 | 200+ |
| Net heat of Combustion, | | |
| D240, KBTU/Gal | 140.1 | 146.2 |
| D4529, KBTU/Gal | 131.2 | 136.7 |

Example 2

A light cycle oil feed having an initial boiling point of 280 degrees F. and an end boiling point of 570 degrees F. and an aromatic carbon content of 62% as measured by nDM method, was fed to a reactor, which comprised a catalyst system, having a liquid hourly space velocity (LHSV) of 1.0 l/Hr. A catalyst system was employed to produce the product. This catalyst system comprised layers of a demetallization catalyst, a hydrotreating catalyst and a hydrogenation/hydrocracking catalyst. The demetallization catalyst comprised Group VI and Group VIII metals, specifically 2 wt % nickel and 6 wt % molybdenum, on a large pore support. The catalyst was promoted with phosphorus. The hydrotreating catalyst consisted of Group VI and Group VIII metals catalysts, which was promoted with phosphorus, on a large surface area alumina, non-acidic support. The total metals were 20 wt %. The hydrogenation/hydrocracking catalyst is a high activity base metal catalyst consisting of 20 wt % nickel/20 wt % tungsten over a large area amorphous silica alumina, where the acidity was enhanced by adding 2 wt % fluoride as hydrofluoric acid. Hydrogen having a pressure of 2250 psig, was fed to the reactor at a rate of 8000 scf/bbl. The temperature of the reactor was 700° F. The pressure differential is 0 psi. The reaction product yields are set forth in Table 2A.

TABLE 2A

| Product | Yield |
|---|---|
| Hydrogen Consumption | 2290 scf/bbl |
| Hydrogen Sulfide (wt %) | 0.14 |
| Ammonia (wt %) | 0.01 |
| C1/C2 Lt. Gas Make (wt %) | 0.13 |
| C3/C4 LPG (vol %) | 0.5 |
| Naphtha (vol %) | 12.1 |
| Jet Fuel (vol %) | 107.3 |
| Diesel (vol %) | 0.0 |
| Total (vol %) | 119.9 |

The reactor products were distilled to yield only a High Net Volumetric Energy Jet product, having a Volumetric Energy higher than 125 BTU/Gallon. The product quality is shown in Table 2B.

TABLE 2B

| | Feed LCO |
|---|---|
| Prodcut: | Jet |
| API Gravity | 36.8 |
| Specific Gravity, G/cc | 0.839 |
| Sulfur (PPM) | <6 |
| Smoke Point, mm: CRTC | 27 |
| Freeze Point (° C.) | −53 |
| D2887 5%/95% F. | 327/509 |
| Net heat of Combustion, D4529, KBTU/Gal | 129.1 |

As with the example 1, the Jet Fuel's Net Volumetric Energy is at 129 BTU/Gal, substantially higher than the 125 BTU/Gallon typical for commercial fuels.

Example 3

The feed employed in Example 3 is a light cycle oil, having an initial boiling point of 283 degrees F. and end boiling point of 572 degrees F. and an aromatic carbon content of 60% as measured by nDM, was fed to a reactor, which comprised a catalyst system, having a liquid hourly space velocity (LHSV) of 1.0 l/Hr. A catalyst system was employed to produce the product. This catalyst system comprised layers of a demetallization catalyst, a hydrotreating catalyst, a hydrogenation/hydrocracking catalyst and a second hydrotreating catalyst. The demetallization catalyst comprised Group VI and Group VIII metals, specifically 2 wt % nickel and 6 wt % molybdenum, on a large pore support. The catalyst was promoted with phosphorus. The hydrotreating catalyst consisted of Group VI and Group VIII metals catalysts, which was promoted with phosphorus, on a large surface area alumina, non-acidic support. The total metals were 20 wt %. The hydrogenation/hydrocracking catalyst is a high activity base metal catalyst consisting of 20 wt % nickel/20 wt % molybdenum catalyst supported on a silica/alumina support where up to 20% of a zeolite has been added. The total metals were 20 wt %. Additionally, a post layer of the same hydrotreating catalyst (i.e., nickel/molybdenum/phosphorus, supported on a large surface area alumina) was added to the catalyst system. The total metals in the post layer was about 20 wt %. Hydrogen, having a pressure of 2250 psig, was fed to the reactor at a rate of 6000 scf/bbl. The temperature of the reactor was 680° F. The pressure differential is 0 psi. The reaction product yields are set forth in Table 3A.

TABLE 3A

| Product | Yield |
|---|---|
| Hydrogen Consumption | 2400 scf/bbl |
| Hydrogen Sulfide (wt %) | 0.18 |
| Ammonia (wt %) | 0.02 |
| C1/C2 Lt. Gas Make (wt %) | 0.13 |
| C3/C4 LPG (vol %) | 1.3 |
| Naphtha (vol %) | 6.7 |
| Jet Fuel (vol %) | 107.7 |
| Diesel (vol %) | 0.0 |
| Total (vol %) | 115.6 |

The reactor products were distilled to yield only a High Net Volumetric Energy Jet product, having a Volumetric Energy higher than 125 BTU/Gallon. The product quality is shown in Table 3B.

TABLE 3B

| | Feed LCO |
|---|---|
| Product: | Jet |
| API Gravity | 35.3 |
| Specific Gravity, G/cc | 0.846 |
| Sulfur (PPM) | <6 |
| Smoke Point, mm: CRTC | 25 |
| Freeze Point (° C.) | −54 |
| D2887 5%/95% F. | 363/520 |
| Net heat of Combustion, D4529, KBTU/Gal | 130.2 |

As with the example 1, the Jet Fuel's Net Volumetric Energy is at 130 BTU/Gal, substantially higher than the 125 BTU/Gallon typical for commercial fuels.

FIG. 1 shows the effect of the jet fuel composition on the net heat of combustion. A ternary diagram was employed to determine the hydrocarbon composition of olefin-free jet fuels as determined by the aromatic, naphthenic and paraffinic, as determined by D2789, content. Also included in this diagram were are constant net heats of combustion lines, as determined by ASTM D4529 and as a function of hydrocarbon composition. These lines were determined form actual net heats of combustion as mapped in the ternary hydrocarbon diagram as shown in FIG. 2.

Table 4 summarized the data plotted in FIG. 1. Also included in Table 4 is comparative data for conventional jet fuel. As can be seen, the high volumetric energy density jet fuel (HVEDJF) of the jet fuel composition of the present invention is about 4 KBTU/Gal higher than the conventional jet fuel as determined by ASTM D4529, a calculated net heat of combustion. This calculated value supports the experimental value corrected by the hydrogen content.

TABLE 4

Jet Fuel Compositions

| | Hydrotreated Cycle Oil | | | | | | | Conventional Jet Fuel |
|---|---|---|---|---|---|---|---|---|
| ID | Ex. A | Ex. B | Ex. C | Ex. D | Ex. E | Ex. F | Ex. G | Comp. Ex. |
| API | 35.7 | 37.9 | 37.0 | 35.5 | 35.5 | 35.7 | 35.7 | 43.6 |
| Specific Gravity | 0.9330 | 0.8335 | 0.8380 | 0.8455 | 0.8455 | 0.8445 | 0.8445 | 0.8064 |
| Nitrogen, ppm | 0.1 | 0.1 | 0.1 | 0.1 | 0.1 | 0.1 | 0.1 | 0.1 |
| Sulfur, wt. % | <6 | <6 | <6 | <6 | <6 | <6 | <6 | 320 |
| Hydrogen, wt. % | 13.73 | 13.85 | 13.73 | 13.59 | 13.48 | 13.34 | 13.32 | 13.78 |
| Smoke Point, mm | 24 | 29 | 26 | 23 | 24 | 25 | 23 | 23 |

TABLE 4-continued

| Jet Fuel Compositions | | | | | | | | |
|---|---|---|---|---|---|---|---|---|
| | Hydrotreated Cycle Oil | | | | | | | Conventional Jet Fuel |
| ID | Ex. A | Ex. B | Ex. C | Ex. D | Ex. E | Ex. F | Ex. G | Comp. Ex. |
| Freeze Point, ° C. | −52 | −53 | −59 | −61 | −59 | −60 | −59 | −46 |
| Aniline Point,, F. | 136 | 141 | 134 | 127 | 127 | 129 | 126 | 134 |
| JFTOT (ASTM D3241): | | | | | | | | |
| Highest Temp. Tested, C. | 310 | 300 | 345 | 350 | 350 | 350 | 350 | 295 |
| Breakpoint Temperature, C. | >310 | >300 | >345 | >350 | >350 | >350 | >350 | 290 |
| Tube Rating | <3 | <1 | <3 | <2 | <2 | <2 | <1 | 1 |
| Pressure Drop (mmHg) | 1 | 0 | 0 | 0 | 0 | 0 | 0 | 0 |
| Net Heat of Combustion. | | | | | | | | |
| D4529, KBTU/Gal | 129.7 | 128.5 | 128.8 | 129.6 | 129.6 | 129.5 | 129.4 | 124.9 |
| D4809, KBTU/Gal | — | 128.3 | 128.2 | 129.7 | 130.0 | 129.4 | 129.1 | — |
| Composition (Mass Spec), % | | | | | | | | |
| Paraffins | 8.8 | 15.6 | 15.7 | 15.1 | 14.9 | 15.0 | 13.8 | 59.0 |
| Naphthenes | 83.0 | 80.0 | 79.8 | 76.4 | 76.4 | 75.5 | 76.9 | 24.3 |
| Aromatics | 8.2 | 4.3 | 4.5 | 8.5 | 8.7 | 9.5 | 9.7 | 16.7 |
| Distillation, D2887 (T ° F.) | | | | | | | | |
| IBP | 333 | 267 | 268 | 262 | 269 | 257 | 243 | 240 |
| 10% | 379 | 352 | 358 | 367 | 367 | 366 | 363 | 315 |
| 30% | 402 | 391 | 388 | 393 | 392 | 392 | 390 | 370 |
| 50% | 421 | 413 | 401 | 408 | 404 | 407 | 406 | 413 |
| 70% | 446 | 437 | 424 | 432 | 432 | 432 | 430 | 455 |
| 90% | 493 | 489 | 472 | 475 | 475 | 475 | 475 | 511 |
| EP | 574 | 600 | 543 | 539 | 544 | 547 | 568 | 590 |
| Characterization Factor, Kw | 11.35 | 11.47 | 11.35 | 11.28 | 11.26 | 11.29 | 11.29 | 11.84 |

What is claimed is:

1. A jet fuel composition, comprising:

(a) an aromatics content of from 7 to less than 22 vol %;

(b) a cycloparaffins content of at least 72 vol. %;

(c) a normal plus iso paraffin content of 8.8 to less than 28 vol. %;

(d) a net heat of combustion of at least 128,000 Btu/gal;

(e) a smoke point above 19 mm by ASTM D 1322;

(f) a JFTOT thermal stability characterized by a filter pressure drop of 0 or 1 mm Hg, a breakpoint temperature above 290 degrees C., and an overall tube deposit rating less than 3 by ASTM D 3241; and (g) an API gravity from 35.3 to 37.9;

wherein the jet fuel composition is derived from a feedstock that has an aromatic carbon content of at least 40 vol % aromatics.

2. A jet fuel composition, comprising:

(a) an aromatics content of between 10 and 20 vol %;

(b) a cycloparaffins content of from about 80 and about 90 vol. %;

(c) a normal plus iso paraffin content of 8.8 to 15.7 vol. %;

(d) a net heat of combustion of at least 128,000 Btu/gal;

(e) a smoke point above 19 mm by ASTM D 1322;

(f) an API gravity from 35.3 to 37.9; and (g) a JFTOT thermal stability characterized by a filter pressure drop of 0 or 1 mm Hg, a breakpoint temperature above 290 degrees C., and an overall tube deposit rating less than 3 by ASTM D 3241.

3. A process for making jet fuel, comprising:

(a) hydroprocessing a feed comprising at least 50 vol % of an FCC cycle oil and that has an aromatic carbon content of at least 40 vol % aromatics to produce a high density jet fuel having (i) an aromatics content of from 7 to less than 22 vol %;

(ii) a cycloparaffins content of at least 72 vol. %;

(iii) a normal plus iso paraffin content of 8.8 to less than 28 vol. %;

(iv) a net heat of combustion of at least 128,000 Btu/gal;

(v) a smoke point above 19 mm by ASTM D 1322;

(vi) an API gravity from 35.3 to 37.9; and (vii) a JFTOT thermal stability characterized by a filter pressure drop of 0 or 1 mm Hg, a breakpoint temperature above 290 degrees C., and an overall tube deposit rating less than 3 by ASTM D 3241.

4. A process for making jet fuel, comprising:

(a) hydroprocessing a feed comprising at least 40 vol % aromatics to produce a high density jet fuel having (i) an aromatics content of from 7 to less than 22 vol %;

(ii) a cycloparaffins content of at least 72 vol. %;

(iii) a normal plus iso paraffin content of 8.8 to less than 28 vol. %;

(iv) a net heat of combustion of at least 129,000 Btu/gal;

(v) a smoke point above 19 mm by ASTM D 1322;

(vi) an API gravity from 35.3 to 37.9; and (vii) a JFTOT thermal stability characterized by a filter pressure drop of 0 or 1 mm Hg, a breakpoint temperature above 290 degrees C., and an overall tube deposit rating less than 3 by ASTM D 3241.

5. A method of increasing energy density of a jet fuel composition comprising (a) mixing a jet fuel composition having an energy density of no more than 127,000 Btu/gal with (b) a jet fuel composition that is derived from a feedstock that has an aromatic carbon content of at least 40 vol % aromatics and that has the following characteristics:

(i) an aromatics content of from 7 to less than 22 vol %;

(ii) a cycloparaffins content of at least 72 vol. %;

(iii) a normal plus iso paraffin content of 8.8 to less than 28 vol. %;

(iv) a net heat of combustion of at least 129,000 Btu/gal;

(v) a smoke point above 19 mm by ASTM D 1322;
(vi) an API gravity from 35.3 to 37.9; and
(vii) a JFTOT thermal stability characterized by a filter pressure drop of 0 or 1 mm Hg, a breakpoint temperature above 290 degrees C., and an overall tube deposit rating less than 3 by ASTM D 3241.

6. A jet fuel blendstock comprising (a) a jet fuel composition having an energy density of no more than 127,000 Btu/gal; and (b) a jet fuel composition that is derived from a feedstock that has an aromatic carbon content of at least 40 vol % aromatics and that has the following characteristics:
(i) an aromatics content of from 7 to less than 22 vol %;
(ii) a cycloparaffins content of at least 72 vol. %;
(iii) a normal plus iso paraffin content of 8.8 to less than 28 vol. %;
(iv) a net heat of combustion of at least 129,000 Btu/gal;
(v) a smoke point above 19 mm by ASTM D 1322;
(vi) an API gravity from 35.3 to 37.9; and
(vii) a JFTOT thermal stability characterized by a filter pressure drop of 0 or 1 mm Hg, a breakpoint temperature above 290 degrees C., and an overall tube deposit rating less than 3 by ASTM D 3241.

* * * * *